United States Patent [19]

Claasen

[11] 4,091,915

[45] May 30, 1978

[54] MACHINE FOR PACKAGING DISPENSING SPOONS AND METHOD

[76] Inventor: Antonius Bernardus Claasen, Sperwerlaan 4, Leende, Netherlands

[21] Appl. No.: 714,493

[22] Filed: Aug. 16, 1976

[30] Foreign Application Priority Data

Aug. 18, 1975 Netherlands ..... 7509802

[51] Int. Cl.[2] ..... B65G 47/24

[52] U.S. Cl. ..... 198/389; 198/391; 221/159; 221/163; 221/171

[58] Field of Search ..... 198/382, 389, 391, 396, 198/398, 399, 400, 473, 678, 681; 221/156, 157, 159, 163, 167, 171

[56] References Cited

U.S. PATENT DOCUMENTS

| | | | |
|---|---|---|---|
| 2,858,930 | 11/1958 | Aidlin | 198/398 |
| 2,908,376 | 10/1959 | Sahagun | 198/396 |
| 3,054,170 | 9/1962 | Benichasa et al. | 198/396 |
| 3,123,251 | 3/1964 | Schneider | 198/391 |
| 3,578,142 | 5/1971 | Burgess | 198/391 |
| 3,658,207 | 4/1972 | Schultz | 198/382 |
| 3,907,099 | 9/1975 | Smith | 198/389 |

*Primary Examiner*—Evon C. Blunk
*Assistant Examiner*—Jeffrey V. Nase
*Attorney, Agent, or Firm*—O'Brien & Marks

[57] ABSTRACT

In the packaging of dispensing spoons with bottles in containers, the spoons are oriented by means of protuberances on shank portions thereof extending normal to the shank in the same direction as the hollow side of the spoon bowl. The spoons are tilted longitudinally either while falling off the end of a conveyor or by a downwardly curved conveyor section. Properly oriented spoons are caught by a wire extending above the conveyor during the tilting to hang the spoons on the wire in a single orientation.

7 Claims, 6 Drawing Figures

FIG.2
FIG.1
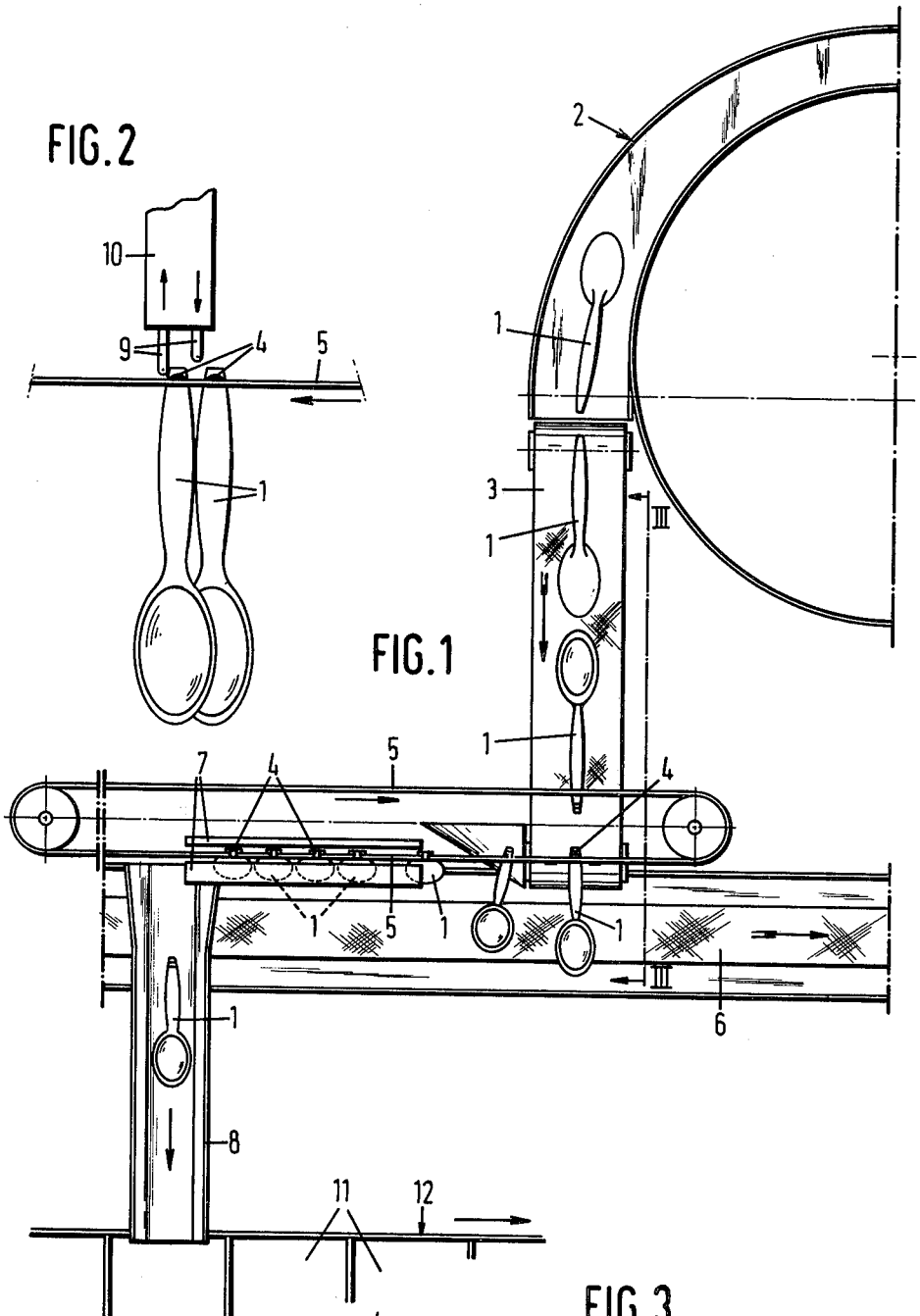
FIG.3
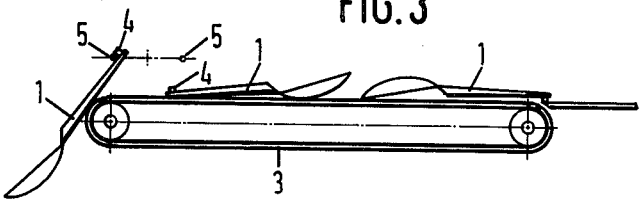

MACHINE FOR PACKAGING DISPENSING SPOONS AND METHOD

FIELD OF THE INVENTION

The present invention relates to a method of machine packaging dispensing spoons together with containers, such a bottles. The spoons have a shank portion joining a spoon bowl at one end. At the opposite end of the spoon, a protuberance is disposed in the direction of the hollow side spoon bowl and substantial normal to the shank.

Of late it has become more and more common practice to add a dispensing spoon to containers for correctly dosing liquid substances to be taken in doses. Hitherto, in packaging the spoon in a box together with the container filled with liquid, powder or the like, the spoons were manually put into the box prepackaged with a container. To avoid this time-consuming and monotonous method, steps have been taken to place the spoons in trays of the supply conveyor for transfer with the containers to the packaging machine. Together with the containers these spoons are each time introduced into an opened box by means of an intermittently moving slide. In case the shank of the spoon has at its end opposite the bowl a protuberance which is substantially normal to the shank, the spoon is prevented from being jammed between the wall of the tray and the slide by being loosely positioned.

When the container is slid out the protuberance serves as a stop, so that the spoon is advanced in a desired way. To ensure that the spoon is packaged together with the container such that the spoon and container take the least possible space, which in general will be the case when the protuberance is caught by the bottom of the container. In the case of a bottle, the bowl of the spoon will lie against the transition from the wide portion of the bottle to the neck. It is desirable that the spoons are fed to the trays in a properly oriented way.

SUMMARY OF THE INVENTION

The invention relates to a method by which it is reliably ensured using protuberances on the spoons, that only spoons are fed which are oriented in the desired manner. To this end, the method according to the invention is characterized in that the spoons are sucessively passed by means of a conveyor with their longitudinal direction substantially in the direction of transport, under a conveying wire or wire-like means in such a manner that the spoons with protuberance extending upwardly to the zone of said wire are caught with said protuberance by the wire, and are suspended from the wire while swivelling about the hooking place in a falling movement away from the conveyor. The spoons are subsequently successively discharged from the wire.

In accordance with a preferred embodiment of the method according to the invention, the spoons immediately preceding the zone of said wire can be passed along a transport path along which those spoons which have their protuberance directed downwardly slide downwardly owing to a falling movement over a face inclined transversely to the direction of transport while tilting substantially along their longitudinal axis. The spoons having their protuberance directed upwardly slide downwards without tilting with their spoon end including the protuberance, reaching a conveyor portion extending adjacent to the intial zone of the transporting wire and along a stop shoulder for the spoons.

Owing to this preferred embodiment of the method according to the invention all spoons arrive at the conveyor after having passed the transport path, with their transverse protuberance at the spoon end directed upwardly, thus achieving a considerably increased supply capacity of spoons suspended from the transporting wire.

The invention also relates to an apparatus for carrying out the above-mentioned method. The apparatus is characterized, according to the invention, by a conveyor for successively feeding spoons in a longitudinal direction to a discharge transport path having above the discharge end thereof a transporting wire or wire like means.

In accordance with a preferred embodiment of the apparatus the discharge transport path comprises in plan view a curved end portion of the conveyor. The beginning of this end portion has a portion which is relatively steeply downwardly inclined towards the inner end and which is transverse to the direction of transport in sectional view. A stop shoulder is disposed along the inner bend and at relatively little distance outwardly thereof, beginning at the end of the transversely inclined portion. The transporting wire which at least partly follows the bent curve of the discharge transport path subsequently extends in a linear path. The portion of the discharge transport path which begins at the end of the transversely inclined portion, ends beyond the place where the transporting wire assumes its linear path, and follows, cross-section transversely to the direction of transport, an outwardly inclined path which becomes gradually steeper.

When, as is known in such conveyors, the drive is effected by a vibratory drive mechanism, it is possible, in accordance with a preferred embodiment of the apparatus in the above embodiment, that the transporting wire be secured to the conveyor, so that the wire also performs the vibratory movement of the conveyor and hence transports.

BRIEF DESCRIPTION OF THE DRAWINGS

The invention will now be described in more detail with reference to the drawings.

FIG. 1 is a plan view of an apparatus for carrying out the method according to the invention;

FIG. 2 is a front elevational view of the apparatus shown in FIG. 1;

FIG. 3 is a view taken along the line III—III in FIG. 1;

DESCRIPTION OF THE PREFERRED EMBODIMENT

Figure 4:
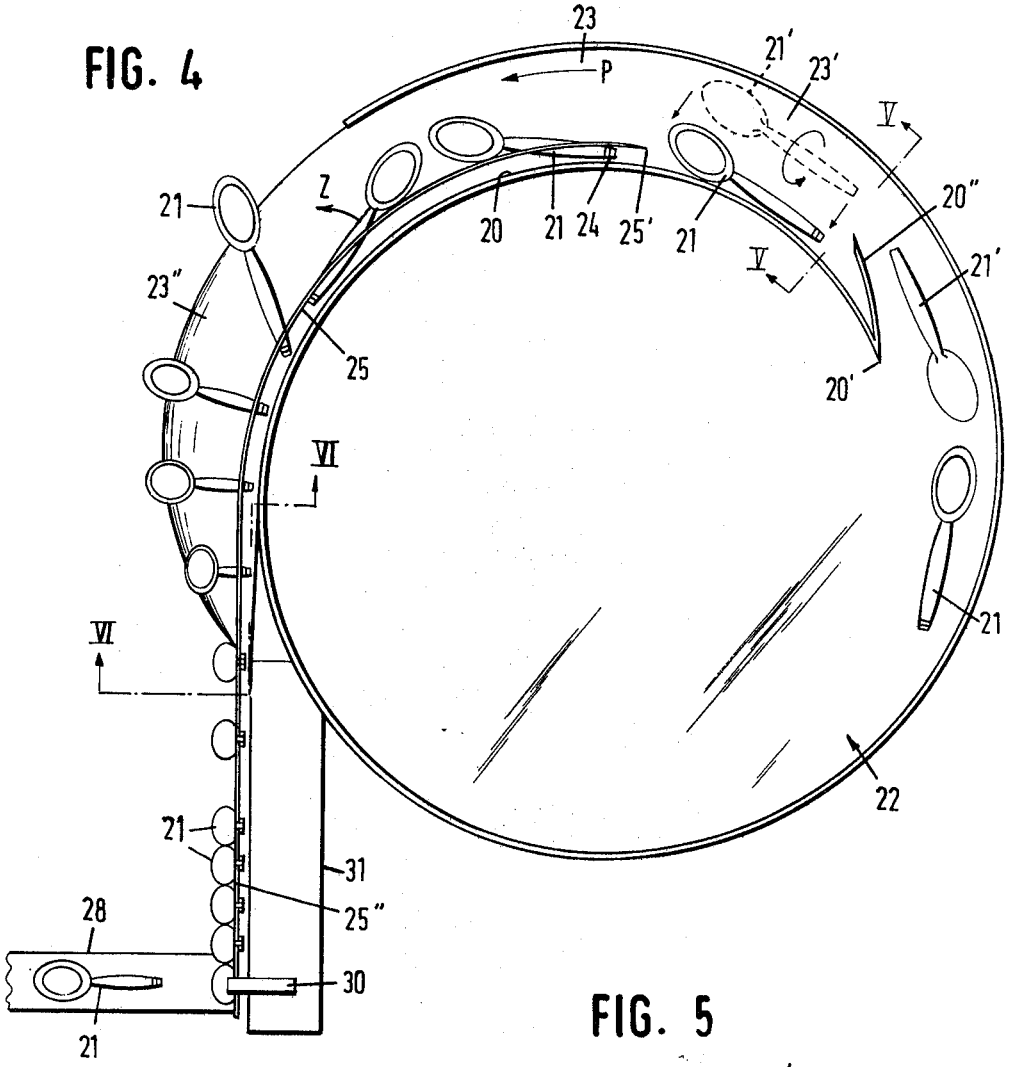
FIG. 4 is a plan view of a different embodiment of an apparatus for feedings spoons in duly oriented form, including a bent discharge transport path forming part of a vibratory conveyor, over which path all transported spoons are fed to the wire in a correctly oriented way.

As can be seen in FIGS. 1–3, the spoons 1 are oriented in longitudinal direction by means of a vibratory conveyor 2 and are subsequently transferred to a transport path 3 at which the spoons can arrive in four positions, namely, with their shank forwardly or backwardly and with the bowls upwardly or downwardly (FIG. 1).

Owing to protuberances 4 projecting transversely from the shanks of the spoons (FIG. 3), those spoons which are directed with their shank backwardly or trailing and with their bowl upwardly are caught or hooked, while tilting when falling from the transport path 3 formed by a separate conveyor belt 3 at the discharge end thereof (see FIG. 2 at the bottom), by a wire 5 disposed above the discharge end. The wire has a transporting function to move with its lower part in FIG. 2 the suspended spoons 1 from the right to the left in said drawing.

The differently oriented and upside-down spoons 1 which are transported along the discharge transport path to the discharge end fall upon a conveyor belt 6 which returns spoons 1 to vibratory conveyor 2 in a manner not shown in the drawings.

A guide 7 ensures that spoons 1 suspended from the transporting wire 5 do not fall until FIG. 1, at the left of the discharge end of transport path 3, the zone above a chute 8 is reached. Here the spoons are discharged one by one by means of a device 10 (see FIG. 2), which causes discharge by means of pins 9.

The spoons fall one by one into chute 8 and arrive in trays 11 (FIG. 1) placed on a conveyor belt 12 for the trays, moving from the left to the right in FIG. 1. The feeding of the containers to the trays is effected in a manner not shown in the drawing, in a place located in the direction of transport of conveyor belt 12 beyond the feeding point of spoons 1.

To increase the capacity, the vibratory conveyor 2 and the transport path 3 can be double. It is possible to arrange this apparatus mirror-symmetrically to the vertical plane through the axis of chute 8, while the transporting wire 5 can then be extended to the left in FIG. 1 and can ensure, with its upper part in said drawing, the transport of the spoons to the same chute 8. The discharge device 10 with pins 9 is in that case also doubled.

Figure 5:
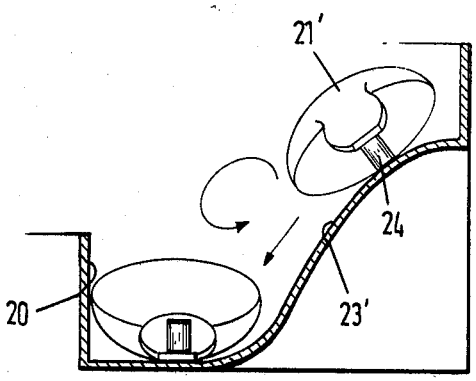
FIG. 5 is a sectional view taken along the line V—V in FIG. 4.
Figure 6:
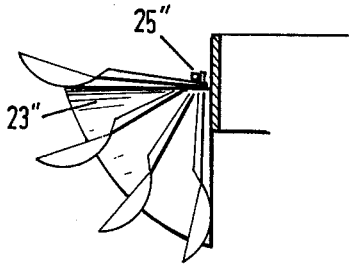
FIG. 6 is a sectional view taken along the line VI—VI in FIG. 4.

In accordance with the embodiment shown in FIGS. 4–6, FIG. 4 depicts in plan view a vibratory conveyor 22, which feeds spoons 21 with their longitudinal direction approximately along the periphery of the vibratory conveyor 22 to a discharge transport path 23 of said vibratory conveyor. Transport takes place in the direction of arrow P in FIG. 4. Reference numeral 20 indicates a stop shoulder along the inner bend of discharge transport path 23 in FIG. 4. The initial part thereof is at reference numeral 20′ from which, obliquely with respect to the direction of transport shown by arrow P, also a branch 20″ extends, which ensures that the spoons which reach the discharge transport path along the periphery of the vibratory conveyor 22, arrive at the outer bend of said path approximately adjacent to the spot where the cross-sectional line V—V in FIG. 4 is drawn.

The initial part of the discharge transport path 23 has the cross-sectional configuration shown in FIG. 5. The spoon indicated in FIGS. 4 and 5 by reference numeral 21′ is positioned with its protuberance 24 in downward direction. Owing to the steeply inclined shape of the support face 23′ over this initial portion of the discharge transport path 23 from the outer bend to the inner bend, spoon 21′ will roll about a longitudinal axis running from the bearing point of protuberance 24 and the extremity of the hollow spoon portion on support face 23′. Spoons having their protuberances directed upwardly slide down incline 23′ without rolling. Finally the spoon arrives at the bottom adjacent the inner bend, where the stop shoulder 20 of discharge transport path 23 is situated, with spoon protuberance 24 being upwardly directed and adjacent to said stop shoulder 20. Reference numeral 25 in FIG. 4 represents a transporting wire which in this embodiment of the apparatus according to the invention is secured to the vibratory conveyor 22 and hence derives its transporting activity from the vibratory movment of the conveyor. The way of attachment of wire 25 to the vibratory conveyor 22 is not shown in FIG. 4, but is of course in such a manner that spoons 21 with their protuberance 24 can be caught by the initial part 25′ of wire 25, i.e. on the side of stop shoulder 20, and further transport of said spoons takes place with their protuberance along the wire 25 up to the end of the wire to be defined herebelow, over the last zone of the wire 25, indicated in FIG. 4 by reference numeral 25″, with their protuberance 24 hooked on the wire.

From approximately the initial point 25′ of the transporting wire 25 the wire follows at relatively little distance the curved shape of the inner edge 20 of the vibratory conveyor 22 up to the extreme left-hand point in FIG. 4 of the stop shoulder 20, from where the transporting wire 25 extends with the linear final path 25″ vertically downwardly in FIG. 4.

The support face of the discharge transport path extends, starting approximately at the end of the steeply inwardly inclined portion 23′, at the right-hand top corner in FIG. 4, up to the zone where the linear wire path 25″ starts, in cross-section transversely to the direction of transport P and inclined from the inner bend to the outer bend outwardly and downwardly by a gradually steeper slope. This zone which inclines outwardly gradually steeper in the direction of transport is indicated in FIG. 4 and — as far as visible — in FIG. 6 by reference numeral 23″.

From the several spoons 21 shown in plan view in FIG. 4 it now appears how all spoons fed along branch 20″ of stop shoulder 20 at the right-hand top corner in the drawing pass to discharge transport path 23, irrespective of which of the four positions mentioned at the beginning of this description of the drawings said spoons assume, arrive at the linear wire path 25″ in a properly oriented form hanging on the transporting wire by means of the protuberances on the spoons.

Those spoons which are forwardly directed with their hollow spoon end, like spoon 21 which is topmost in FIG. 4, slide with the hollow part initially more or less forwardly in the direction of transport and gradually down the falling support face 23″ to tilt the spoons.

Those spoons which lie with their hollow spoon portion upstream in the direction of transport such as the spoon indicated by reference numeral 21′ in the right-hand top corner in FIG. 4, travel during the falling of support face 23″ along the discharge transport path 23. At the same time there is effected a rotating movement in plan view in counter-clockwise direction, as shown in FIG. 4 at the left-hand top corner by arrow Z as well as a tilting movement of the spoon as shown in FIG. 6.

Finally, all spoons arrive at the linear final path 25′ of the transporting wire 25″ with the shanks tilted upward and hooked or hanging on the wire by means of the protuberances, and are discharged at the end above a chute 28 by a device 30 not further shown in the drawing in accordance with the above device 10.

Reference numeral 31 in FIG. 4 shows a support by means of which the downstream end of the transporting wire 25, i.e. the final zone of wire path 25", is connected to the vibratory conveyor 22.

It will be clear that the invention is not limited to the embodiments described above and shown in the drawings but that all kinds of variants are possible without departing from the scope of the present invention.

I claim:

1. A method for use in packaging dispensing spoons which comprises the steps of:

(a) successively moving spoons on a conveyor, the spoons each having a shank portion joining a spoon bowl at one end and at the opposite end having a protuberance disposed in the direction of the hollow side of the spoon bowl and substantially normal to the shank, said spoons being aligned on said conveyor in a longitudinal direction substantially in the direction of travel;

(b) passing said aligned spoons under a wire-like transport means disposed near the horizontal termination location of the conveyor;

(c) hooking the protuberances of certain spoons which are properly positioned in an upward direction on the conveyor with the wire-like transport means while tilting the spoons upwardly as the spoons exit from the conveyor; and (d) transporting spoons hooked by means of the protuberances on the wire-like transport means to a discharge outlet, said spoons being transferred from the wire-like transport means to the discharge outlet while in a uniformly aligned direction.

2. The method for use in packaging dispensing spoons of claim 1 wherein the spoons are moved longitudinally on a substantially horizontal conveyor under said wire-like transport means which is transversely positioned above the exit end of the conveyor, and the properly positioned spoons are hooked as their shank portions tilt upward when falling off the exit end of the conveyor.

3. The method for use in packaging dispensing spoons of claim 1 wherein the spoons are successively moved on the conveyor of step (a) by means of a vibrator and pass to a steeply inclined arcuate sloping surface where spoons positioned in a downward direction are caused to roll over to invert and where spoons positioned in an upward direction are caused to slide without rolling over to retain their position by means of the protuberances projecting from the shank of the spoons.

4. An apparatus for use in packaging dispensing spoons each having a shank portion joining a spoon bowl at one end and at the opposite end having a protuberance disposed in the direction of the hollow side of the spoon bowl and substantially normal to the shank, the apparatus comprising in combination:

(a) a conveyor for having the spoons disposed thereon;

(b) a wire-like transport means disposed above a substantially horizontal portion of the conveyor to engage the protuberances of spoons oriented with their protuberance extending upward, and positioned near a termination location of the conveyor so as to hang the engaged spoons thereon by means of the protuberances as the spoons tilt upward; and (c) means for operating the wire-like transport means to transport the spoons hanging by the protuberance of the wire-like transport means to a discharge outlet where spoons are discharged from the wire-like transport means in a uniformly aligned direction.

5. The apparatus for use in packaging dispensing spoons of claim 4 wherein the conveyor includes a horizontal conveyor, the wire-like transport means extends transversely over the exit end of the horizontal conveyor so as to engage upward extending protuberances on trailing shanks of spoons as the spoons tilt over the exit end of the horizontal conveyor and wherein the wire-like transport means is spaced above the horizontal conveyor so that spoons positioned in a downward direction on the conveyor pass under the wire-like transport means.

6. The apparatus for use in packaging dispensing spoons of claim 4 wherein the conveyor is vibrator operated and includes a steeply inclined arcuate surface having a sloping profile for causing spoons positioned in a downward direction to roll over to invert and for causing spoons positioned in an upward direction to slide without rolling over to retain their position.

7. The apparatus for use in packaging dispensing spoons of claim 6 wherein a plow is disposed prior to the sloping surface for aligning the spoons longitudinally along the conveyor.

* * * * *